US006588435B1

(12) United States Patent
Gindi

(10) Patent No.: US 6,588,435 B1
(45) Date of Patent: Jul. 8, 2003

(54) COSMETICS APPARATUS

(76) Inventor: Isaac Gindi, 350 Fifth Ave., Rm. 3009, New York, NY (US) 10118

( * ) Notice: Subject to any disclaimer, the term of this patent is extended or adjusted under 35 U.S.C. 154(b) by 0 days.

(21) Appl. No.: 09/818,241

(22) Filed: Mar. 28, 2001

Related U.S. Application Data

(63) Continuation of application No. 09/353,204, filed on Jul. 14, 1999.

(60) Provisional application No. 60/132,527, filed on May 5, 1999, provisional application No. 60/118,036, filed on Feb. 1, 1999, provisional application No. 60/097,642, filed on Aug. 24, 1998, and provisional application No. 60/093,857, filed on Jul. 23, 1998.

(51) Int. Cl.[7] ..... A45D 33/00; A45D 24/00; A45D 29/00

(52) U.S. Cl. ..... 132/293; 132/73; 132/200

(58) Field of Search ..... 132/293, 318, 132/317, 320, 73, 200; 206/38, 38.1, 540, 528; 340/573.1, 686, 687, 692

(56) References Cited

U.S. PATENT DOCUMENTS 4,072,314 A * 2/1978 Rosen et al. ..... 273/161
4,861,505 A * 8/1989 Farman ..... 252/92
5,174,440 A * 12/1992 Chiu ..... 206/38
5,573,109 A * 11/1996 Isacson ..... 206/38.1
5,955,958 A * 9/1999 Lu ..... 340/691.5
6,007,502 A * 12/1999 Lee ..... 601/17
6,024,625 A * 2/2000 Pearce ..... 446/81
6,104,292 A * 8/2000 Rombom et al. ..... 340/573.1
6,315,163 B1 * 11/2001 Shu ..... 222/39

* cited by examiner

*Primary Examiner*—John J. Wilson
*Assistant Examiner*—Robyn Kim Doan
(74) *Attorney, Agent, or Firm*—Morris E. Cohen

(57) ABSTRACT

A container for health and beauty aids having a novel cap and a cap therefor are disclosed. The cap has a recess in which an entertainment device is disposed. The entertainment device may include a touch activated light and/or sound package. When the user depresses an element on the cap, a touch switch is activated, and the light package lights up and/or the sound package generates a sound or noise. Alternatively, the cap may include one or more fluids disposed in the cap; the fluids are preferably immiscible. Small items such as glitter or confetti may be suspended in the fluids.

11 Claims, 8 Drawing Sheets

COSMETICS APPARATUS

RELATED APPLICATIONS

The present application claims the priority of U.S. Provisional Application Serial No. 60/093,857 filed Jul. 23, 1998; U.S. Provisional Application Serial No. 60/097,642 filed Aug. 24,1998; U.S. Provisional Application Serial No. 60/118,036 filed Feb. 1, 1999; and U.S. Provisional Application Serial No. 60/132,527 filed May 5, 1999. The disclosures of all of these applications are fully incorporated herein by reference. The application is a continuation of 09/353,204 Jul. 14, 1999.

BACKGROUND OF THE INVENTION

Cosmetics containers are well known in the art. A large variety of such containers are currently commercialized and sold. They include small cases, such as tubes or circular cases for containing lipstick, mascara, eyeliner, lipliner, nail polish, and other health and beauty aids. Such containers, with the cosmetics included therein, are widely used by people from adolescence to old age. It is an object of the present invention to provide a novel series of new containers of health and beauty aids, as well as new cosmetics, particularly for girls in their teenage years.

SUMMARY OF THE INVENTION

It is an object of the present invention to provide novel health and beauty aids containers for girls in their teenage years.

It is a further object of the present invention to provide health and beauty aids containers having novel devices integrated or associated therewith.

It is a further object of the present invention to provide an integrated multipurpose health and beauty aids container.

It is a further object of present invention to provide a new nail polish composition for use to coat a person's nails.

Further objects of the present invention will become apparent in conjunction with the disclosure herein.

In accordance with the present invention, a series of novel containers for health and beauty aids are provided herein having devices associated therewith. A variety of different devices are disclosed, including, but not limited to, toys, light making devices, sound making devices, tactile devices, and so forth. The devices can be integrated into the cosmetics container or attached thereto, whether to an internal portion of the container, to the exterior, or to the container walls themselves. In an alternate embodiment of the invention, the devices can be integrated into hair accessories, and/or other home, bath and beauty products.

In a preferred embodiment of the present invention, the invention fulfills the above and other objects and includes a cosmetics container having a recess adapted to hold cosmetics and a cap securable onto the main section sealing the recess. An entertainment device is incorporated in the cap. In a preferred embodiment, the entertainment device includes a touch activated light package disposed in the cap. The light package preferably includes a light source, a power supply electrically connected to the light source, and a touch switch connected to the light source and the power supply. When the touch switch is depressed, the light source is activated. Alternatively or in addition, a sound generating device is provided. When the touch switch is depressed, the sound generating device is activated.

In further embodiments of the invention, the inventions herein can be used in any health and beauty aids, including cosmetics, home, bath and beauty products. The inventions could also be used in conjunction with hair accessories, footwear accessories, and so forth.

Detailed Description of the Invention and the Preferred Embodiments

Description of the invention will now be given with reference to FIGS. 1–9*f*. As shown in connection with the attached drawings, in accordance with the present invention, a variety of different cosmetics containers are provided having entertainment devices associated therewith. The containers can be tubular, circular, cylindrical, jarlike, or any other shape, and include any of the containers used in the art for containing cosmetics, whether lipstick, mascara, eyeliner, lipliner, nail polish or so forth.

The inventions are particularly suited for girls in their teenage years, although, women of a range of ages may find them particularly novel and enjoyable. Moreover, although a series of embodiments are provided herein, the embodiments are not meant as a limitation, as further embodiments may be provided consistent with the present disclosure and the appended claims. Likewise, combinations of the embodiments described below may be provided, as well.

Figure 1:
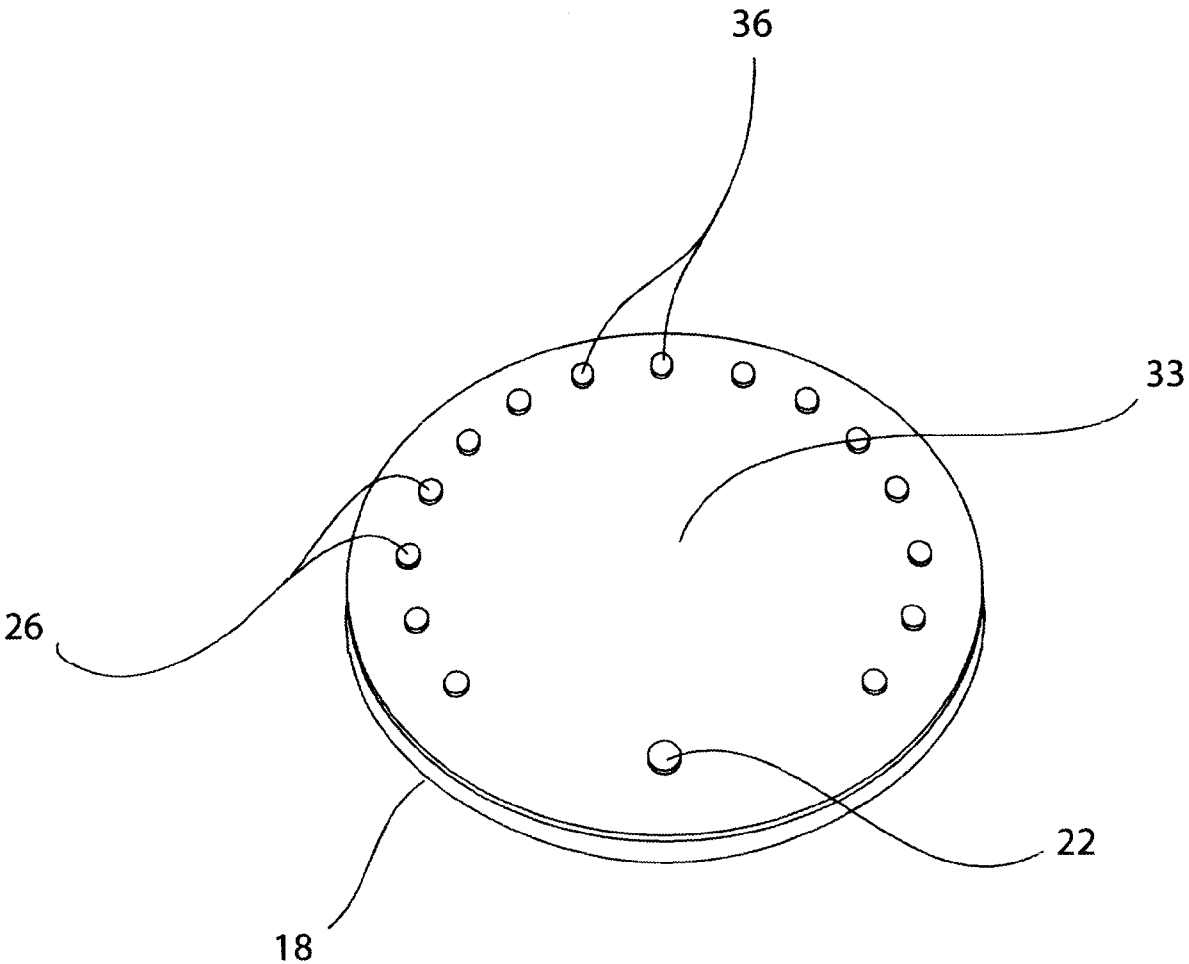
FIG. 1 is a top plan view of a compact case as a first embodiment of the invention.

As shown in FIG. 1, in a first embodiment of the invention, one or more light making devices are incorporated into a cosmetics case, such as a cosmetics compact container 18. Container 18 is provided with a mechanism 22 for activating a light 26. Mechanism 22 can be a pressure activated switch (as shown in the figure), a rotating member (not shown), or any other of the numerous types of switches known in the art.

In one embodiment of the invention, switch or mechanism 22 closes a connection allowing current to flow from a battery to complete a circuit illuminating the light. However, this method is not exclusive, and any method known in the art for activating a light can be utilized consistent with the present invention.

In alternative embodiments of the invention, as with the other entertainment devices of the present invention, the entertainment device can be interior to the case or external to it. Thus, in the light-making device embodiments, the light 26 can be within the case, as described above, or can be on the case'exterior or surface. For example, in one embodiment of the invention, light 26 is located within the interior of cosmetics container 18. In one such embodiment, walls 33 of the cosmetics container 18 are transparent or translucent so that, upon activation, the light 26 is visible through the walls of the case. In a further embodiment, the walls are opaque, such that the light illuminates inside the container to provide an effect when the cap is removed. In yet a further embodiment, light or lights 26 are provided on the outside of the container, in one or more positions 36, to form a pleasing visual effect.

Figure 3:
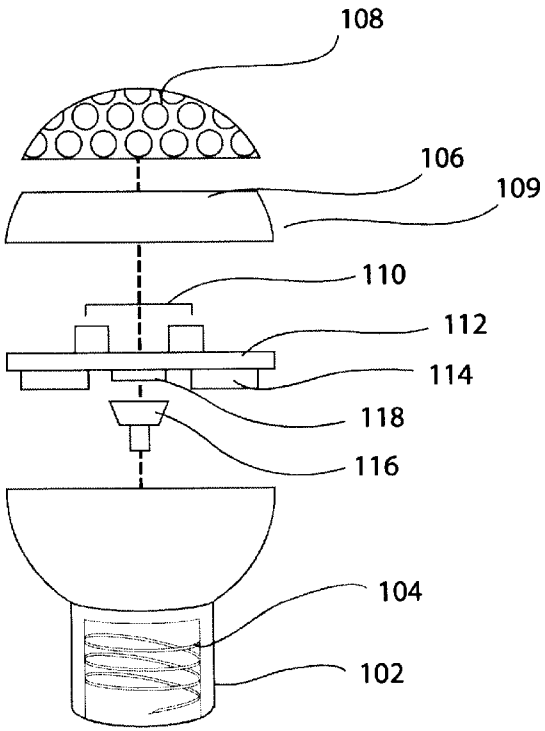
FIG. 3 is an exploded side view of the cap of FIG. 2.

Light 26 can be any one of the many types of lights available in the art. A standard light can be provided, a blinking light, a series of lights (such as a traffic light), a neon or glowing light as shown in FIG. 3, a "black light", or so forth. Thus, in one embodiment, the light can be a blinking light located within the case which goes on whenever the user opens it. Or, the light can be a light on the exterior of the case which the user can turn on at will, for example to provide a series of the blinking lights on the exterior (as shown by elements 36 in FIG. 1). The light or entertainment device can be provided to a standard shaped container, or can be provided to a container with a novel shape, such as the shape of a star, as with a transparent or translucent star shaped internally lit container.

In the embodiment shown, the light is manually turned on by the user when the user desires, as, for example, by application of pressure to mechanism 22. In an alternative embodiment, the light can be activated automatically, i.e. whenever the user opens the cosmetics container, which in the present example is effected by opening the shell of the cosmetics container.

Figure 2:
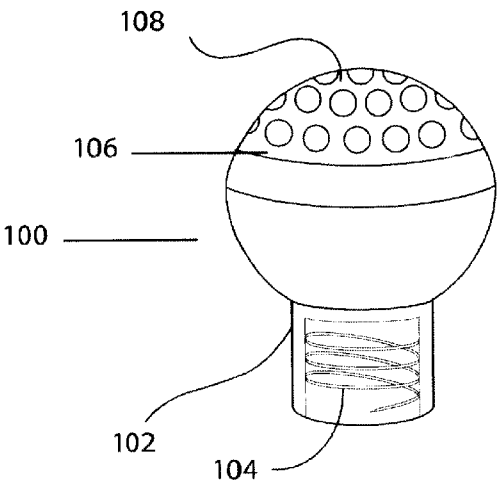
FIG. 2 is a side view of a cap for a cosmetics container as another embodiment of the invention.

Another embodiment of the invention shown in FIGS. 2–3 is a cap for cosmetics containers such as those used to contain nail polish and the like. The transparent or translucent cap of the cosmetics container comprises a microvibrator circuit with two transistors connected to liquid crystals or light emitting diodes (LEDs). By pressing on the cap, the microvibrator is activated and produces a blinking light of different colors. The inside surface of the cap can be designed to focus or refract the light and to provide a further visual effect, e.g. using reflective safety lighting material. In one embodiment, such refractive material in the cap is a refractive, faceted, plastic such as are used in the reflectors for the wheels of bicycles and the like.

In a further embodiment, pressure sensitive liquid crystals can alternatively or additionally be used in the plastic cap. When pressure is applied to the cap, the crystals produces different colors in response. These colors can vary in appearance depending on the angle of light hitting the cap.

As shown in FIG. 2, cap 100 has a base 102 having screw-on threads 104 internally disposed. Alternatively, base 102 may be of the snap-on variety. The top, preferably globular portion, of cap 100 is predominantly hollow. Retaining ring 106 keeps lens or refractor 108 secured to the top of cap 100. Lens 108 is preferably transparent or translucent to allow visual examination of the entertainment device disposed within the cap. Lens 108 may also be provided with a reflector or refractor to change the appearance of the contents of the cap.

As shown in FIG. 3, disposed in the hollow recess of cap 100 is light package 109. Light package 109 includes LEDs 110 mounted on circuit board 112. Battery or batteries 114 are also mounted on circuit board 112 and provide power for light package 109. Circuit board 112 sits on a platform (not shown) in cap 100 and rests on an elastic piece 116.

In one embodiment, when the user depresses the top of cap 100, e.g., lens 108, circuit board 112 is pressed downward by the rim of lens 108 thereby pressing touch switch 118 into contact with elastic piece 116. This contact activates a circuit (not shown) on circuit board 112 which causes batteries 114 to activate LEDs 110. Preferably, a timer is built into the circuit so that LEDs 110 are automatically deactivated after a predetermined period of time. Also preferably, instead of merely lighting LEDs 110 steadily, a blinking or flickering pattern of flashing lights may be preprogrammed into the circuit.

In addition to its value for providing a pleasing visual effect, an internal light for a cosmetics case can be useful to allow a woman to illuminate the case or a mirror in the case, when she opens it. This can be particularly useful to allow the woman to apply makeup when she is in a dimly or non-illuminated area.

In the alternative or in addition to LEDs 110, cap 100 may include a noise or sound generating device connected to the circuit and touch switch 118 in the same manner as LEDs 110. Thus, when the user depresses lens 108, the sound generating device is activated. Any sound or noise is contemplated, e.g., music, animal noises, sound effects, verbal messages, etc.

In a further embodiment of the present invention, a flexible electroluminescent material and/or reflective safety lighting is applied to the cosmetics container as the desired lighting.

The flexible electroluminescent technology is currently known in the art. The technology uses a thin, flexible, paper-like material which illuminates in response to the passage of electricity therethrough. This material can be in a strip form or so forth. This flexible electroluminescent lighting technology is produced, for example, by Smartec Smart Technology, a Hong Kong company. Either the electroluminescent wire ("EL wire") or electroluminescent plate (EL plate) currently available (or any other electroluminescent form of material) can be used in conjunction with the present invention.

Illumination of the material produces a pleasing visual appearance to the observer. For example, the material can illuminate to produce a neon blue lit block through the strip. The illumination can be constant or can be periodic to produce a blinking effect. Any shaped material can be provided For example, the material can be made into any decorative shape desired, such as a geometric shape, a fruit or vegetable shape, charms (such as a locket), a key hole, a seasonal design (such as Christmas tree), animated characters, or so on.

The reflective safety lighting is also known in the art. Such safety lighting is well known, and is utilized, for example, in reflectors used by bicyclists and pedestrians. Such reflectors are generally made of a plastic material and reflect light which is incident on the reflector. In one embodiment of these reflectors, a large number of cut facets in the material reflects light off of the reflector, making the reflector easier to see, particularly in low lighting conditions. They are currently used to make bicycles and pedestrians more visible to motor vehicles, especially during the nighttime. Any walls of the container body or cap can be constructed from the reflective safety lighting material.

The electroluminescent technology and/or reflective safety lighting can be used in conjunction with any of the embodiments of the present invention.

For example, any of the walls or portions of the container or cap can be provided with the electroluminescent technology previously described. In one embodiment, the strip is provided within the walls of the container or pouch, or between a double walled portion. The strip is connected to a power source which is used to direct electricity through the strip, causing it to illuminate. A power button or other mechanism is used to turn power on and off, illuminating the strip either with constant illumination or blinking illumination.

As with the other embodiments of the invention, the invention can be applied to numerous different types of cosmetics containers. Thus, although the invention is described in FIG. 1 with reference to a cosmetics compact (e.g. for mascara) the invention can be provided in a lipstick case, a nail polish cap, a cosmetics jar, or any other container for cosmetics. For example, FIGS. 2–3 show a cap which may be used for a container of nail polish.

Figure 4:
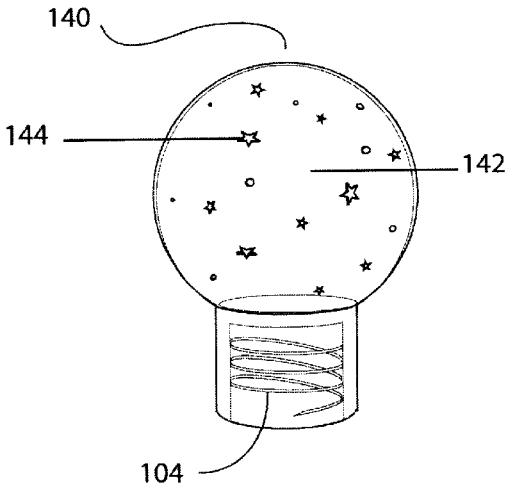
FIG. 4 is a side view of a different cap for a cosmetics container as a third embodiment of the invention.

In further embodiments of the invention, novel cosmetic pouches and/or plastic or dome caps of cosmetics cases can be provided. In some such embodiments, such pouches and caps may be partially or totally filled with colored water or any other colored liquid or gel. For example, in one embodiment, the cap has transparent double walls and the space between the walls contains such colored liquid or gel. Likewise, the cap (or other portion) of a cosmetics container (or cosmetics pouch) can be dome shaped, with the dome having liquid therein. Small toys may also be suspended in this liquid or gel, as shown in FIG. 4. Cap 140 is substantially hollow and contains liquid 142. The liquid may include a suspension of a plurality of small items 144 such as glitter, confetti, or reflective or non-reflective items in any shape desired. Alternatively or in addition, the liquid 142 may include two or more immiscible fluids of different colors and, optionally, different viscosities. A user may shake the cap and container and observe the fluid(s) and/or suspended items moving around.

In further embodiments of the invention, the cosmetics container has a toy integrated therein or attached thereto. For example, a "koosh ball" may be attached or affixed to the cosmetics container. This koosh ball can further be of the glow in the dark variety, if desired.

Numerous other toys can be integrated with or attached to the cosmetics case in accordance with the present invention. These toys can be integrated with or attached to any portion of the cosmetics container, whether as part of the container walls, the container's lid or cap, or so forth.

In one embodiment, the toy is a compass. In a further embodiment, dice are provided in the walls of the container or attached thereto. For example, a container wall can be provided which can be opened to remove the dice from within the walls of the container. In a further embodiment, other trinkets are provided within the container or its walls. In a further embodiment, the toy is a game device.

In another embodiment, the toy is a combination type lock. If desired, this combination type lock, or another lock, can be used to "lock" the cosmetics case. Alternatively, it can be used for purely visual effect, or to be locked and unlocked merely as an amusement, or to lock the cosmetics case to an object.

In another embodiment a mirror can be provided on the outside of the cosmetics container. The mirror can be circular in shape or of any other shape desired. As an alternative to a mirror, the cover or any portion of the outside of the container can have a cutout of a different color or composition than its background. For example, the cover of a cosmetics container can be a material such as plastic which is opaque in color with a shaped area which is of a different color, or transparent, or translucent. The reverse is also possible. Likewise, the cutout area can be illuminated by a light beneath it, or the background to the cutout can be illuminated.

In yet a further embodiment, the toy can be one in which the user attempts to manipulate small metal balls into specific holes. In another embodiment, the user attempts to manipulate small metal balls through a maze. Or, the user could attempt to manipulate small toy cars into parking spaces. The latter is currently used in the small, handheld, "Parking the Car" game toy, which is commercially available.

In a further embodiment, the toy is a chalk board type of slate. This chalk board can be on the exterior or in the interior of the container, and is preferably provided with chalk for the user's amusement. In another embodiment, the toy is a puzzle type game with movable puzzle pieces. In another embodiment, the container (e.g. its cap or lid etc.) can have a tambourine integrated therewith or attached thereto.

Alternatively, the container can have a roulette wheel integrated therewith or attached thereto. This allows the user to "play roulette" with the cosmetics case. In another alternate embodiment, the container can have a magnifying glass. In yet a further embodiment, the container can be or can include a round clear plastic exterior ball containing another round object (such as a spherical compass) that swivels and rotates within it. In another embodiment, the container can include an inking stamp.

In another embodiment, the container can include finger puppets. These puppets can be attached to the cap of a cosmetics container, either removably or permanently. Alternatively, toy hats or the like can be attached to the cap of the cosmetics container.

In a further embodiment, the cosmetics container can have a whistle, or a pencil sharpener attached or as an integral part of the cap of the container. This is particularly useful for lipstick containers, or the cap of a nail polish container. Instead of a whistle, an eraser can be provided, or a colored pencil, or a pen, a crayon, or a pencil.

Numerous other types of toys can be provided as part of the cosmetics container. The cap can include or have affixed a winding tube containing liquid, or a water "love meter" type of cap containing liquid. Alternatively, the liquid in the cap can be oil based, or viscous, such that it flows slowly. Or, the cap can contain a "water wheel," in which water flows from one chamber or portion of the cap to another. Instead of flowing water, flowing powder can be used, as with an hourglass.

Additional types of toys which can be attached to or part of a cap, or another portion of the cosmetics container are shown in the figures, as well. The cap can be shaped as a screwdriver. Or, it can be shaped as a faucet fixture. The cap can also be shaped as a "U.F.O. top"™. Or, it can have feathers or Malibu feathers on it.

The cap can be of a colorful acrylic or, it can be of a "lace plastic," e.g. a plastic having lace within it. The cap could, alternatively, have glitter embedded therein.

The cap or cosmetics container can also have a toy which makes sounds affixed thereto or integral therewith, e.g., a "groan tube." Such a toy makes sounds when it flipped in orientation. Alternatively, it could have such toys as a miniature telephone toy, a keyboard type toy, a guitar type toy, or a toy having buttons on it, each of which generates a predetermined sound. The entire cosmetics container could be in the shape of any one of these toys (e.g. a mini phone), or could have the toy on its cap. Each of these toys preferably have buttons on it, which, when depressed, generate sounds or musical tones.

Figure 5:
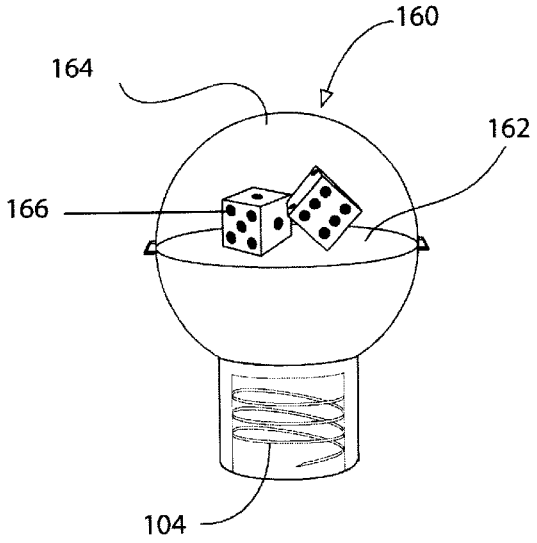
FIG. 5 is a side view of a still different cap for a cosmetics container as a fourth embodiment of the invention.

In other embodiments of the invention, the toy can be an "Etch-a-Sketch"® type device for drawing. Or, the toy can be a dome with a die or dice beneath it which are popped around in response to pressure on the dome, e.g., a "pop-o-matic ®", as in the popular game "Trouble®" as shown in FIG. 5. As is known in the art, the pop-o-matic 160 typically includes a flexible sheet 162 and a cover or dome 164. A die or dice 166 are disposed on-but not secured to-sheet 162. Sheet 162 is biased in a first position. Depressing the dome 164 pushes sheet 162 into a second position. Releasing the dome causes the natural biasing force of the sheet to snap back to its first position, randomly "tossing" the dice 166 inside dome 164. Alternatively, any other mechanism for achieving this effect can be utilized.

The toy can also be a "swirl and spin" type of game in which there is a dome top and a rotating platform at the base of the dome, the platform being rotated in response to pressure on an actuating mechanism on the top of the dome, or being capable of being rotated manually. One such activating mechanism may include a pull cord.

In a further embodiment of the invention, the cap has a clear outer surface and a hollowed out interior with a rotatable picture, or the like, located therein. As opposed to a picture, a roulette type wheel, or any other desired object can be included therein. A lever on the side of the cap is moved to cause the picture or internal object to spin. If a roulette wheel is used, a silver ball is included in the interior, which will drop into one of the slots of the roulette wheel when the spinning of the wheel is complete.

As another embodiment, the toy may be activatable by a pull cord, e.g., a talking doll, a Speak-and-Spell®, or the like. The pull cord may cause sounds and/or lights to be generated and/or may cause relative motion of one or more components of the toy.

Figure 6:
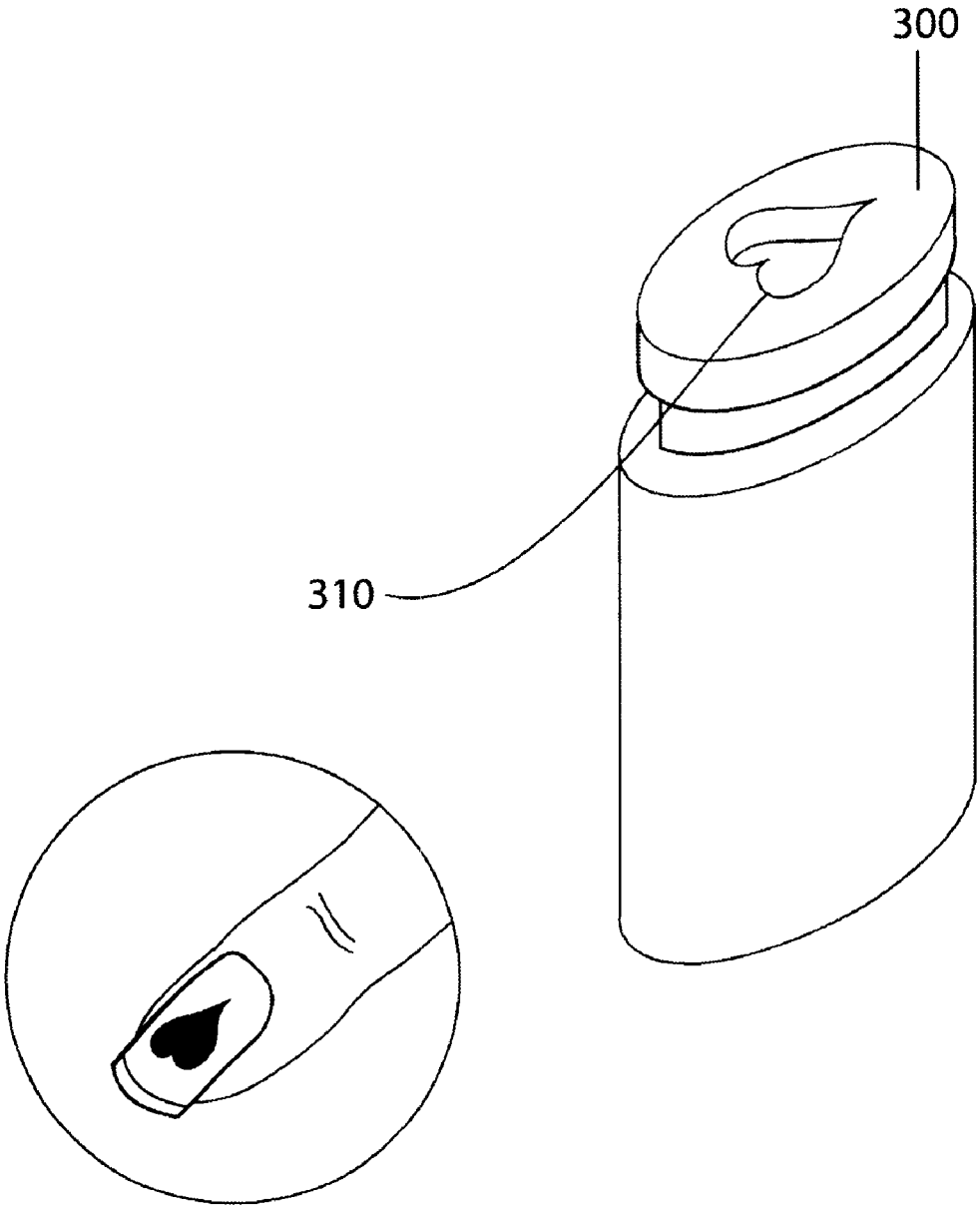
FIG. 6 is a perspective view of a fifth embodiment of the invention.

As shown in FIG. 6, in a further embodiment of the invention the cosmetics container has a stencil 300 attached to it. Such a stencil may be attached to the bottom, side, top, or to the lid cover of the container. The stencil is used by the consumer to apply nail polish to nails in a desired shape, by placing the stencil over the nail and applying nail polish to the stencil. A cut Out portion 310 of the stencil 300 may have any desired shape and may be used for application of this design. Nail polish is applied to the stencil through the cut out portion 310, which results in the application of polish to merely a portion of the user's nail in a desired shape, as shown in the figure. The stencil can be removed and reattached to the bottle, if desired. This invention, like the other inventions in the present application, can be used in conjunction with any of the other inventions of the present inventor, or with any other features or technologies known in the art.

Figure 7:
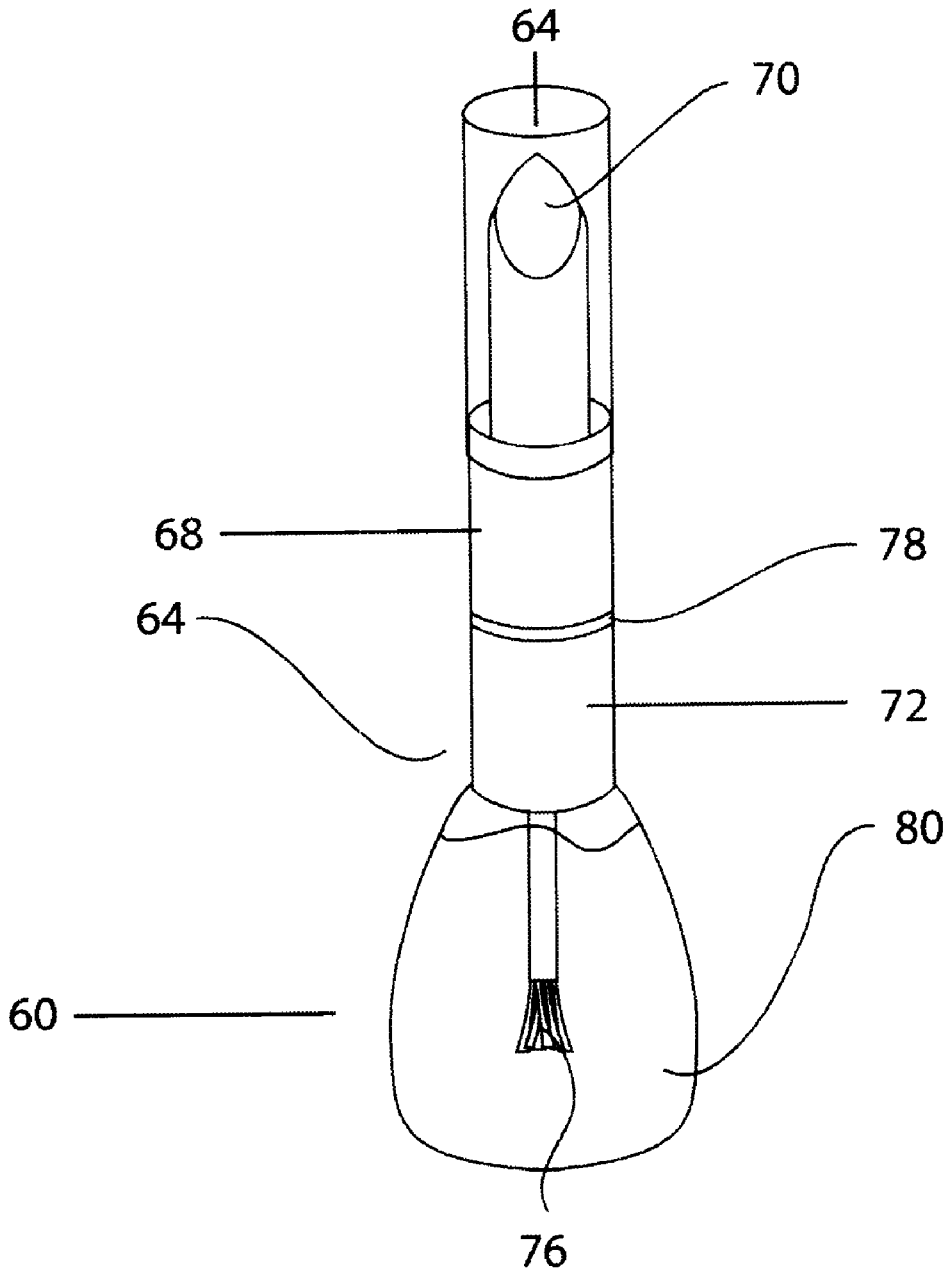
FIG. 7 is a side sectional view of a cosmetics container as a sixth embodiment of the invention.

In a further embodiment of the invention, the cosmetics container is multifunctional, providing two or more types of cosmetics in an integrated container designed to deliver both. In the preferred embodiment, an integrated container is provided for delivering both lipstick and nail-polish from the same unit. The two types of cosmetics are nestled together, as with a mini lipstick cap within a cap. Preferably, however, the multifunctional unit is as in the design shown in FIG. 7. As shown in FIG. 7, cosmetics container 60 includes a cap 64 having an upper section 68 and a lower section 72. Upper section 68 includes lipstick 70 and lower section 72 includes a nail polish brush 76 attached thereto. Nail polish brush 76 dips into nail polish 80. Upper section 68 and lower section 72 are secured to each other at seam 78, and preferably detach from each other along that seam. For example, upper section 68 can screw into lower section 72 to allow the upper section to be screwed in and out of the lower section. Thus, a user can maintain her nail polish and lipstick together integrated into the same container. In this manner, she always has them together on hand, and does not need to separately search for both types of cosmetics when she wants to apply them. Moreover, if desired, she can change and vary the lipstick attached to the nail polish bottle, (or she can vary the particular nail polish) so that she has the desired combination of cosmetics (for that day, or week or so forth) kept together.

Any of the above inventions can also be provided in conjunction with a cosmetics container that has a dome shape, preferably clear cover, although opaque covers are possible, as well.

The cosmetics containers, for example bottles and jars, can be made of a frosted or opaque glass with clear window-like designs. This frosted or opaque section can be on any portion of the container. These designs can be in any desired shape, whether the shape of hearts, butterflies, daisies, stars and so on, as further disclosed below with respect to the container cover. The design can be frosted (or opaque) with the background being clear, or vice versa.

Likewise, the containers can also have clear covers which have a shape provided on them (e.g. a cutout shape hot stamped thereon). The opposite is also possible, with the background of the cover being opaque and the foreground being of a clear design. This figure can also be in any desired shape, whether a geometric shape, fruit or vegetable shape, charms (such as a locket), a key hole, a seasonal design (such as Christmas tree), animated characters, or so on. The actual hot stamp which makes the design look and feel like it is part of the lid cover could be in any color and any type of decorative paper, resin or plastic, including, for example, a holographic design or glow-in-the-dark plastic. The background of the cover can also be hot stamped instead of the foreground. Different designs can also be electroplated onto the cosmetics container or its cover. The electroplating technique may also be used for other decorative purposes in connection with the present invention.

In a further embodiment of the invention, the container is similar to that of U.S. Pat. No. 5,531,318, issued Jul. 2, 1996, the disclosure of which is fully incorporated herein by reference. However, in the present invention, instead of holding candy, the holder holds lipstick, lip-liner, chapstick or the like therein.

In a further embodiment of the invention, a cosmetic composition and method for application to a woman's nails is provided. The composition is a new nail polish for application to a woman's nails. Specifically, the nail polish is a paint composition previously used for cars and motorcycles. This paint composition has been sold under the brand name DIAMONT, and labelled EXTREME, by BASF Corporation Automotive Refinish, located in Dearborn Mich., 48124. The color type is MIS-28067 Rainbow (Midcoat on). According to the label, the composition appears to consist of N-Butyl Acetate 123-86-4; Methyl Isobutyl Ketone 108-10-1; Xylene 1330-20-7; Trade Secret 489909 5017-P-NLR; Ethyl Benzene 10d 41-4; and remaining contents partially unknown, although the exact contents of the bottle are best obtained from the manufacturer to the extent they are available.

This composition creates a polish containing three different colors, although it is believed that other numbers of colors may be possible as well. The paint composition produces an unusual effect wherein the polish appears different or of different colors from different angles, analogous to (although not identical to) the effect observed in an oil slick. Although the sample referred to above produces an effect with the three colors blue, purple and green, the invention is not, of course, intended to be limited to those three particular colors.

In accordance with the method of the present invention, this paint or composition, which was previously applied to cars and motorcycles, is applied to a woman's nails. Specifically, the composition is provided to users in a nail polish bottle, as with the prior nail polish bottles common in the art. In accordance with the method, a person can then use this nail polish composition to apply the nail polish composition to the person's own or to another's nails.

In an additional embodiment of the invention, the cosmetics contained in the cosmetics container can further include gel caps or confetti. By gel caps, the present inventor refers to small capsules such as those currently used in shower gels, which contain oils therein. One example of currently available gel caps which can be used with the present inventions are the gel caps sold by Lipo Chemicals, Inc. of Patterson N.J., under the trademark Hypan® Hydrogels. According to the manufacturer, Hypan® Hydrogels are a family of hydrophilic/hydrophobic block copolymers which exhibits thixotropic behavior, resulting in improved tactile properties, waterproofing, emulsification, and viscosity improvement. They are available as anionic, cationic and amphoterics, for elegantly versatile cosmetic formulations.

By confetti, the present inventor refers to an additive for cosmetic, personal care, and topical treatment products which consists of decorative and functional flakes suspended in a moisturizing gel base. According to the manufacturer, the product adds an artistic quality to clear products while also contributing moisturization and delivering an oil soluble active ingredient directly to the skin. The product is provided by United-Guardian, Inc. of Hauppauge, N.Y.

In accordance with the present invention, however, the gel caps can include oils, and/or colored material, and/or powders, and/or glitters, and/or fragrances. These gel caps are preferably suspended in a water-based gel such as body gel, hair gel, or so forth, or in a non-water based material such as a lacquer. Upon application of the cosmetic to the user, the gel cap will streak different colors, and release a powder, glitter, oils, conditioning oils or materials, or fragrances.

Instead of a gel cap, crystals of one or more colors can be used. Such crystals can produce pleasing color or multicolor effects. The crystals can be used in any color cosmetic substance, although, in the preferred embodiment they are used in a dark base.

In an additional embodiment of the invention, the cosmetics contained in the cosmetics container is a gel-like substance that can be used as a mascara, lipstick, lip-gloss, cream or any other known cosmetics. The gel can contain fragrance, as well. In one preferred embodiment, the fragrance is created using a"headspace" technology. The headspace technology samples and then replicates different aroma profiles which correlate to some aroma perceived by human nose and brain. This technology is provided, for example, by ACS Labs and ASIST, Inc. of Cleveland, Ohio. For example, headspace technology can be used to sample and then recreate the smell of a spring field after a rainstorm, or a tropical beach, or a summer garden, or so forth. This scent can be added directly to the gel or to the gel caps described above.

A photochromic or thermochromic effect can also be added to the gel, in accordance with a further embodiment of the present invention. The photochromic effect will allow the gel to change color shade (e.g. from a shade ranging from blue to yellow) in response to light (e.g. ultraviolet light provided by sunlight). The thermochromic effect will allow the gel to change color shade ranging from blue to yellow depending on the temperature. In one embodiment, dark colors appear in response to warm temperatures and light colors appear in response to cool temperatures. Glitters, crystals and gel caps described above can also be added to the gel. Additionally, a temperature or light sensitive oil may be applied to the glitter foil creating glitters that will change their color based on temperature or light. Two or more gels with different effects can be combined in one container creating a two-tone effect or multi-effect when applied.

In a further embodiment of the invention, holographic images are provided on the cosmetic container. For example there can be placed on a sticker on the container, or placed directly onto the container material itself. They can be used with any of the containers described herein. In one preferred embodiment, they can be used in a dome cap. Likewise, they can also be used with or without lights and/or music, and/or on a mini-turntable or spinning platform to create a "pinning effect".

In a further embodiment of the invention, a suspended toy is placed in the cosmetic in the container. This toy can be fabricated in any shape desired, such as, a fruit, an instrument, a specific person or character, or so forth. It can also be made of any material desired, such as glass, plastic, gel, wood, metal, or so forth. Alternatively, the toy could be a gel bead, such as those described above, which is shaped in the desired shape of the fruit, instrument, person or character, or whatever other specific object is desired, rather than a spherical or capsular gel bead as is known in the art. The toy can be enclosed in any shape container or type of container, with any type of cosmetic fill (e.g. polish, gel, mascara, compact, etc.). The toy could be a gel cap or could be plastic.

In a further embodiment of the invention, a toy is attached to the container, preferably on its outside, such as a spinning pinwheel or windmill. This toy could be one which spins when the air or wind blows on it, or could be of the "wind-up" variety, which are wound up and then released to spin freely.

Figure 8:
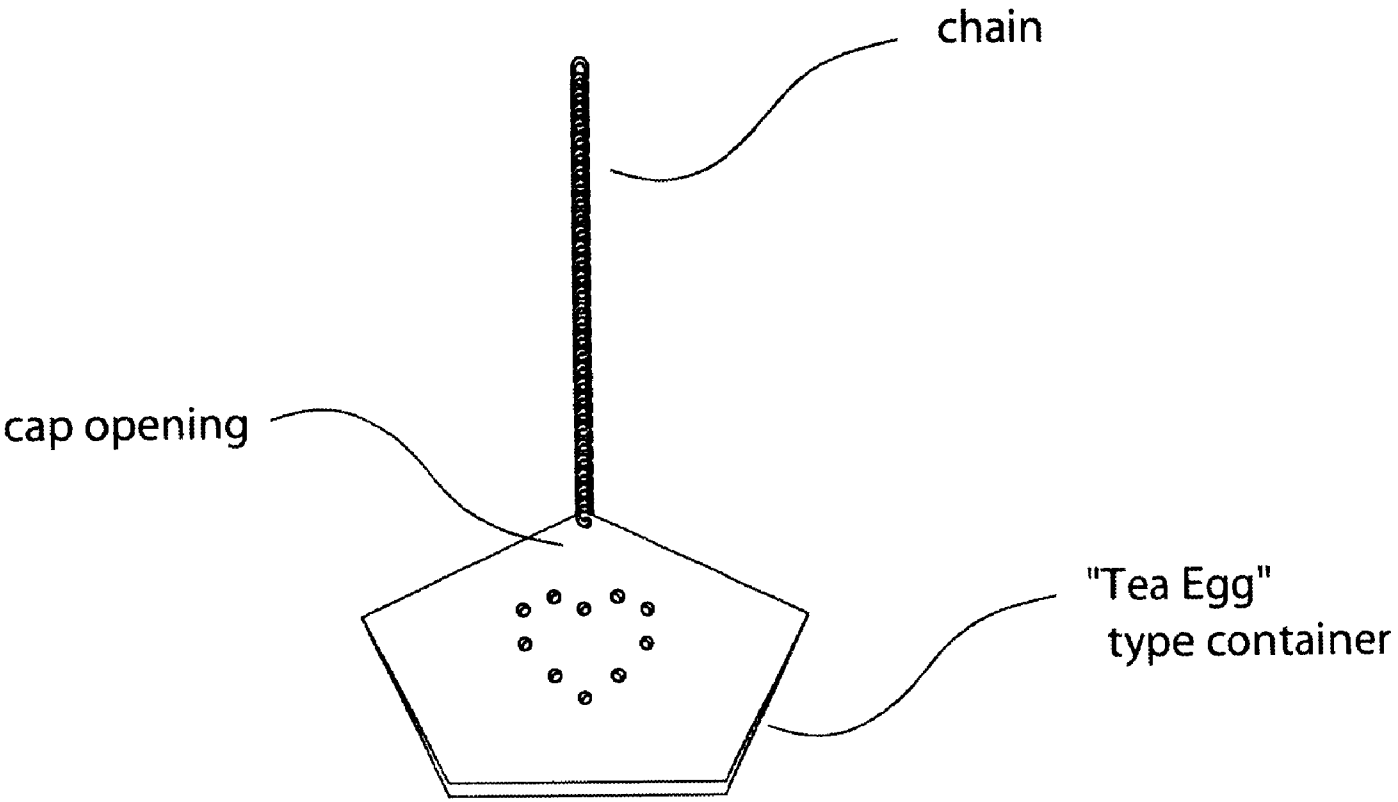
FIG. 8 is a side view of a seventh embodiment of the invention.

In a further embodiment of the invention, the cosmetics container is shaped as a tea ball or tea egg, i.e. those containers which have been used in the past to soak tea leaves in water; however, in accordance with the present invention, cosmetics are placed therein. In an alternative embodiment of the invention, fragrances or fragrant objects are placed in the tea egg. The tea egg can be separate and by itself, or can be attached to a chain, such as a key-chain for example, or to a clip. The outside of the tea egg can be metallic, or can be covered with some coloring or substance. In one embodiment, the tea egg will glow in the dark. It is preferred that, rather than being merely random or symmetrical, the holes in the side of the egg are arranged to make the shape of an object. For example, in one preferred embodiment, the holes in the side of the tea egg make the shape of one or more hearts. One tea egg, in accordance with the invention, is shown in FIG. 8.

In a further embodiment of the invention, the cosmetics container is a flip-top type of container, as shown in FIG. 9. FIG. 9*a* is a front cross-sectional view of the container in a closed position, in accordance with the invention. FIG. 9*b* is a front view of the invention. FIG. 9*c* and FIG. 9*d* are a side view and a back view, respectively, of the cosmetics container of the invention. FIG. 9*e* is a front cross-section of the container in an open position, in accordance with the invention. FIG. 9*f* is a side view of the container in accordance with a further embodiment.

Figure 9A:
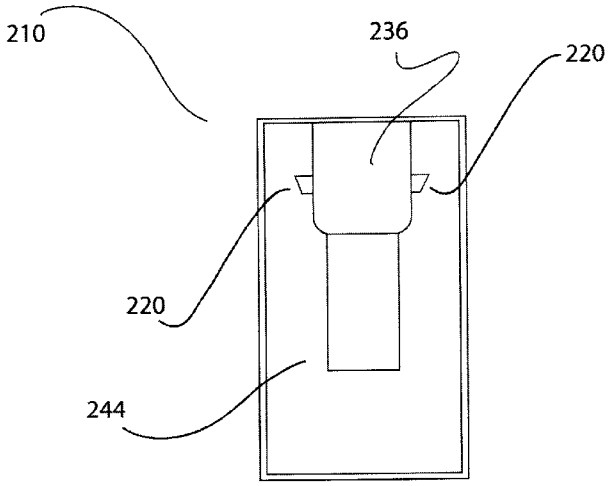
FIGS. 9*a–f* are schematics of an eighth embodiment of the invention.

As shown in FIG. 9*a*, a container 210 is provided. The container 210 is similar to the construction of the Power Rangers® toy previously sold to children. In accordance with the invention, however, the container is provided with a cosmetics preparation therein. In the preferred embodiment of the present invention, the container is used to hold a cosmetic preparation for application to the lips, such as lipstick or lip-liner. Cosmetics container 210 includes a base 236 mounted on pivots 220. Secured to base 236 is lipstick or lip-liner 244. In the normal, resting position, depicted in FIG. 9*a*, lipstick or lip-liner 244 is housed inside the cosmetics container 210 with the lipstick or lip-liner held in the downward or upside down position.

Figure 9B:
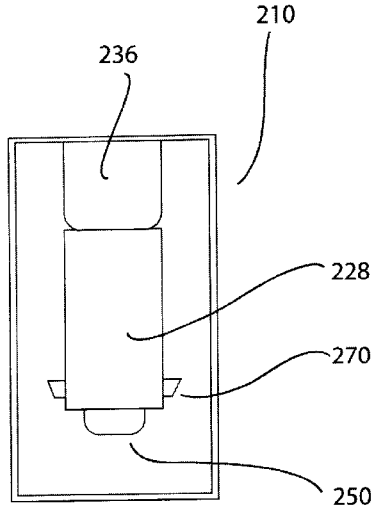
Figure 9C:
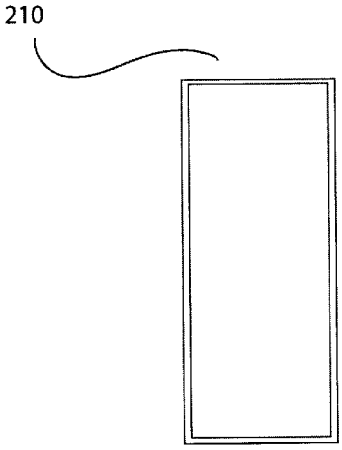
Figure 9D:
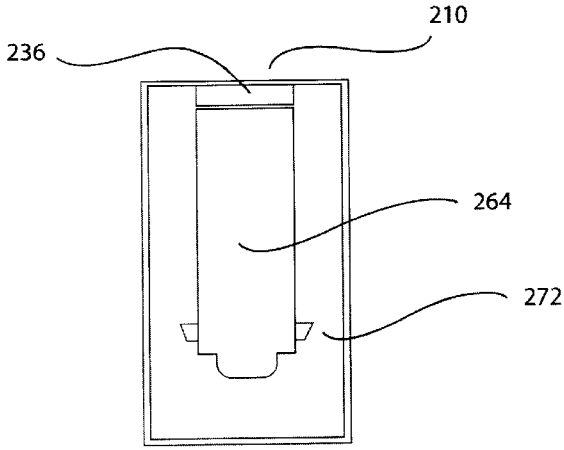
Figure 9E:
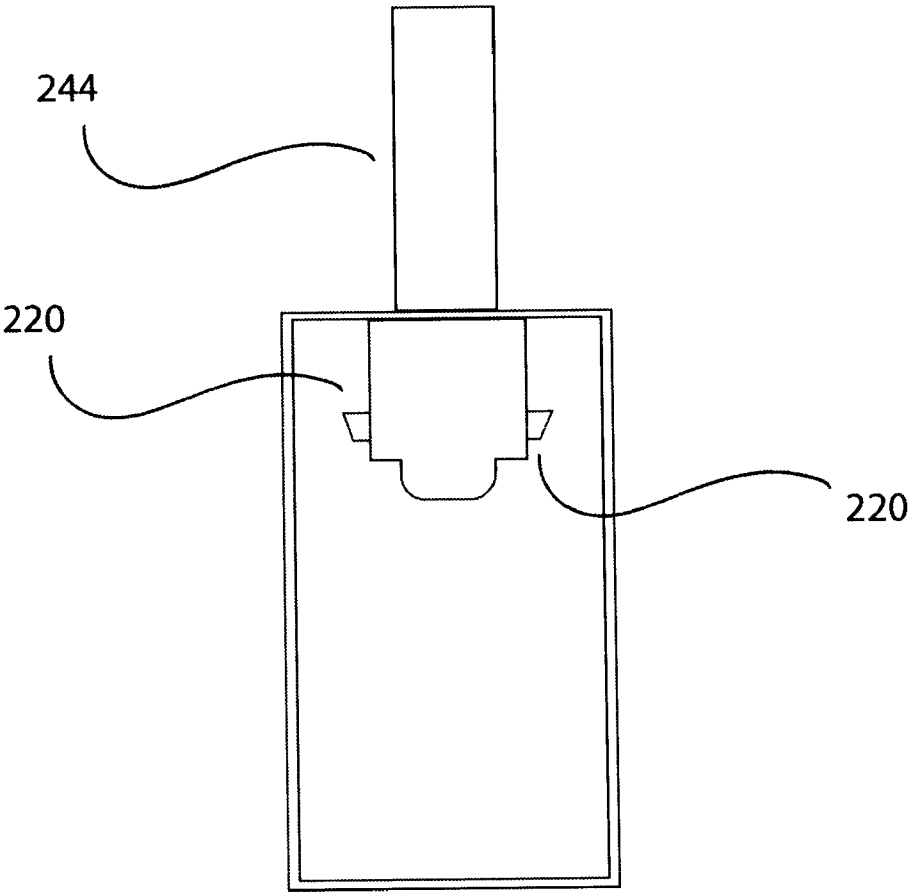
Figure 9F:
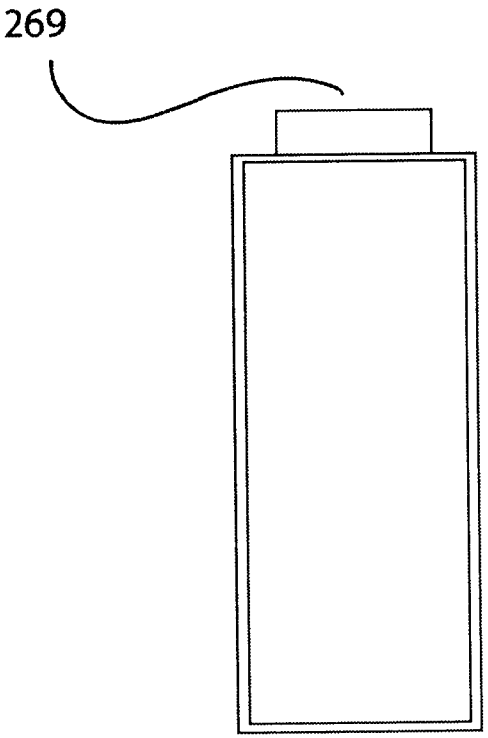

As shown in FIG. 9*b*, when the container is closed, and the lipstick or lipliner is held downward, cover flap 228 on the outside of cosmetics container 210 covers lipstick or lipliner 244. Cover flap 228 is mounted on pivots 270, with springs located on the inside of the container to bias the cover to the closed position in which the cover flap 228 is flush with the outside of the container. Cover flap 228 includes activation mechanism 250, which, preferably is a protuberance such as an elevated square of rectangular section, which sticks out from or above cover flap 228.

To use the container, the user presses down on activation mechanism 250. Exerting pressure on activation mechanism 250, rotates cover flap 228 and back flap or cover 264. Cover flap 228 rotates about pivot 270 and back flap 264 rotates about pivot 272, with the top end of both the cover flap 228 and the back flap 264 rotating away from container 210 to provide a clear path for lipstick 244 to rotate. Normally, cover flap 228 rests against base 236, preventing the base from rotating. Base 236 of container 210 is spring mounted such that, when cover flap 228 is removed, base 236 rotates outward to move lipstick or lip-liner into the upright position shown in FIG. 9*e*.

To close the container, the user can press on the base to rotate it back into the resting position shown in FIG. 9*a*. Alternatively, the user can pull on extension 269 which has rotated into the downward facing position, to pull it into the upward facing position, thereby rotating lipstick or lipliner 244 downward. In one embodiment of the invention, extension 269 can be in the shape of a toy or a character, a person'head, or any other desired object.

In accordance with the invention, any of the embodiments of the present invention can likewise be used in conjunction with hair accessories, with the hair accessory being modified in a manner similar to the modification of the cosmetics container or product disclosed herein. Likewise, any of the embodiments of the present invention can also be provided with respect to or in conjunction with other home, bath and/or beauty products, as desired.

Having described this invention with regard to specific embodiments, it is to be understood that the description is not meant as a limitation since further embodiments, modifications and variations may be apparent or may suggest themselves to those skilled in the art. It is intended that the present application cover all such embodiments, modifications and variations. The scope of the invention is defined by the claims appended hereto.

What is claimed is:

1. A method comprising the steps of:

(a) providing a container for entertaining a child;

(b) said container comprising a recess holding cosmetics therein;

(c) said cosmetics being selected from the group consisting of: nail polish, mascara, eyeliner, lipstick, lipliner, and lipgloss;

(d) said container further comprising an entertainment device, and wherein said entertainment device is a device which produces a verbal message such that said entertainment device talks to the child.

2. A method as claimed in claim 1, wherein said cosmetics container further comprises a power supply, said power supply being electrically connected to said entertainment device.

3. A method as claimed in claim 2, wherein said cosmetics container further comprises a touch switch connected to said power supply, wherein depression of said touch switch activates said entertainment device.

4. A method as claimed in claim 3, wherein said cosmetics container comprises an exterior and wherein said touch switch is activatable from said exterior.

5. A method as claimed in claim 1, wherein at least a portion of said cosmetics container is in the shape of a musical instrument.

6. A method as claimed in claim 1, wherein said entertainment device is touch activated.

7. A method as claimed in claim 1, wherein said cosmetics container comprises a cap, and wherein said entertainment device is located in said cap.

8. A method as claimed in claim 1, wherein said cosmetics container further comprises at least one light.

9. A method as claimed in claim 1, wherein said cosmetics container further comprises multiple colored lights.

10. A method as claimed in claim 1, wherein said container is provided for the use of a girl in her teenage years.

11. A method as claimed in claim 1, wherein said entertainment device is activated by pulling a cord.

* * * * *